US005819850A

United States Patent [19]

Lee, Jr. et al.

[11] Patent Number: 5,819,850

[45] Date of Patent: Oct. 13, 1998

[54] GEOTECHNICAL GROUTING DEVICE AND METHOD

[76] Inventors: Landris T. Lee, Jr., 204 Azalea La.; Daniel A. Leavell, 418 Ridgewood Dr.; Philip G. Malone, 107 Fox Run La., all of Vicksburg, Miss. 39180

[21] Appl. No.: 582,800

[22] Filed: Jan. 4, 1996

[51] Int. Cl.[6] ..... E21B 33/13

[52] U.S. Cl. ..... 166/290; 166/177.4; 175/21; 405/240

[58] Field of Search ..... 175/21, 22, 19, 175/314; 166/285, 290, 334, 177.4; 405/254, 253, 269, 240, 241, 242, 248, 257, 256; 73/864.43, 864.64, 864.65, 864.66

[56] References Cited

U.S. PATENT DOCUMENTS

| | | | |
|---|---|---|---|
| 1,459,990 | 6/1923 | Reed | 166/285 |
| 2,010,778 | 8/1935 | Stechert | 405/240 |
| 2,578,996 | 12/1951 | Endersby | 175/22 |
| 3,479,829 | 11/1969 | Goodman | 166/285 X |
| 3,869,869 | 3/1975 | Pao Chen | 405/240 |
| 4,804,050 | 2/1989 | Kerfoot | 175/20 |
| 5,176,219 | 1/1993 | Cole et al. | 166/290 |
| 5,487,431 | 1/1996 | Webb | 175/20 |

*Primary Examiner*—Hoang C. Dang
*Attorney, Agent, or Firm*—Luther A. Marsh

[57] ABSTRACT

The invention relates to a grout injection device and method for depositing a liquid grouting material in a hole formed by a cone penetrometer. The device is a modular design with a sliding sleeve member that replaces older grouting injection devices with exit port opening actuated by fluidic pressures with an improved more reliable mechanical design that is actuated by withdrawal of the cone penetrometer pipe string by friction between the sliding sleeve and the soil wall formed by the cone penetrometer. The invention solves the problem of pressure losses that can occur with prior art devices resulting in partially opened grout exit ports. The instant invention's design also achieves proper channeling of the grout flowing out of the device's grout exit ports for even distribution of grout filling the hole. This is achieved by the invention's boss structures mounted on an adapter unit of the device. The inventions method allows the cone penetrometer system to perform subsurface surveys and subsequent grouting events in a single penetrometer push event without the need for first retrieving the survey instrumentation and then going back into the hole with a stand-alone grouting device.

6 Claims, 2 Drawing Sheets

GEOTECHNICAL GROUTING DEVICE AND METHOD

STATEMENT OF GOVERNMENT INTEREST

The invention described herein may be manufactured and used by or for the United States Government for governmental purposes without the payment of any royalties thereon.

FIELD OF THE INVENTION

The invention relates to a device and method for use in a cone penetrometer system. More specifically it is a grout injection device that permits injection of a particulate or chemical grout into a penetrometer's hole in a single push operation event as the cone penetrometer is withdrawn therefrom.

BACKGROUND OF THE INVENTION

Prior cone penetrometer grout injection systems use a port that is plugged by an expendable tip on the penetrometer's end section. The grout is injected into the penetrometer hole by using fluid pressure to blow the tip off of the penetrometer rod to open an exit port for the grout to flow into a hole formed by the penetrometer. Any fluid pressure loss in this type of injection system prevents the port from being opened. If the expendable tip is partly dislodged, fluid pressure is only partially released and the port cannot be completely opened. This type of grouting system cannot be used simultaneously during a single penetrometer push operation in conjunction with a soil or water sampler as can now can be achieved by the instant invention since such a penetrometer system requires: i) the entire internal volumetric space of the penetrometer rod and ii) do not segregate an internal grouting tube as now provided for by the instant disclosed invention. Moreover, this type of system after conducting a penetrometer survey requires that the hole be sealed by inserting a tremie tube after the penetrometer rod has been brought to the surface. Grout is pumped down through the tremie tube to fill the hole. This system is successful only if the hole remains open throughout its' length after the penetrometer is retracted.

U.S. Pat. No. 5,176,219 entitled "Method of Sealing Holes in the Ground" by Cole et al., which is hereby incorporated by reference, teaches of such a grouting injection system with an expandable cone tip with grouting injection ports located on a telescopic internal tubular sleeve assembly near the cone tip. This design has several deficiencies in addition to those already mentioned, viz.: i) the internal pressurized piston assembly with seals that is a more complex, less reliable mechanical design compared to the instant invention since the instant invention's design requires only a single slidable sleeve for opening the grouting exit ports; ii) it is inserted into a previously-formed hole whereas the instant invention can remain in the hole during a single subsurface survey/grouting event where grouting begins as the rod pipe string withdraws from the hole, i.e. the instant invention's method combines survey/grouting events into one event; and iii) the grouting section can only attach at the bottom of the penetrometer rod whereas the instant invention's can attach at any desired location on the rod, thus enabling attachment of other devices such as samplers and sensors at the rod tip.

Another prior type of cone penetrometer grouting injection system is a sidewall grout injection system that injects grout above an end of a penetrometer rod. Water and soil samplers are typically designed to use the body of the probe to collect such samples. By necessity, grout must be injected into the penetrometer hole at a location above the sampler. This type of injection design uses two expendable curved plates that fit flush with sidewalls of the penetrometer and cover ports located above the end portion of the penetrometer. Fluid pressure applied to the ports dislodges the plates. These plates are pulled away by shear forces exerted by the surrounding soil as the penetrometer rod is pulled from the hole. This design has several deficiencies, viz.: i) the sidewall plates may block the penetrometer hole; ii) the plates, which must be machined to fit the penetrometer, are lost on each push; iii) the plates can jam between the hole and the rod and make extraction of the rod difficult; and iv) this design does not include features for creating channels so that grout can flow past the lower portions of penetrometer rod and into the open hole. The invention herein is an improvement over either the expendable sidewall plate or expendable tip system designs since replaceable plates or tips are obviated by the instant invention.

In particular, the instant invention's embodiments of i) a slidable sleeve that covers and protects the grout ports and ii) protuberance structures that creates channels in the hole's soil walls for even grout distribution filling the hole resolves the above mentioned problems.

SUMMARY OF THE INVENTION

The invention relates to a grout injection device and method for depositing a liquid grouting material in a hole formed by a cone penetrometer. The device is modular in design with a sliding sleeve member that replaces older grouting injection devices with exit port opening actuated by fluidic pressures with an improved more reliable mechanical design. The invention solves the problem of pressure losses that can occur when using these prior art devices that results in partially opened exit ports. The instant invention's design provides for proper channeling of the grout flowing out of the device by creating cavities in the wall of the penetrometer hole that results in an even grout distribution in the hole. This is accomplished by the invention's boss structures mounted on an adapter unit of the device. The invention also provides for an efficient cone penetrometer methodology of a single survey/grouting operation.

Accordingly, several objects and advantages of the invention herein include providing a grouting injection device that is more reliable since only positive mechanical member actuation is used for the injection system to uncover grouting exit ports from the device, not fluid pressure as required by most prior devices where even small pressure leaks can render the device inoperable; and an array of shaped protuberances for creating channels in the hole walls, thus allowing uniform distribution of grout as the penetrometer unit is withdrawn in a single survey/grouting event.

DETAILED DESCRIPTION OF THE INVENTION

Figure 1:
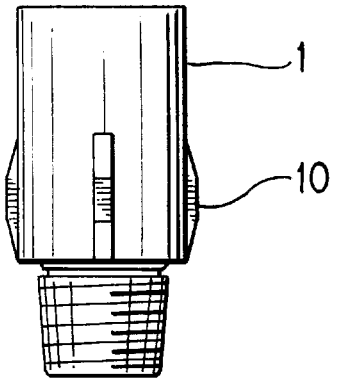
FIG. 1 shows a side view of the adapter portion of the device in accordance with the present invention.
Figure 2:
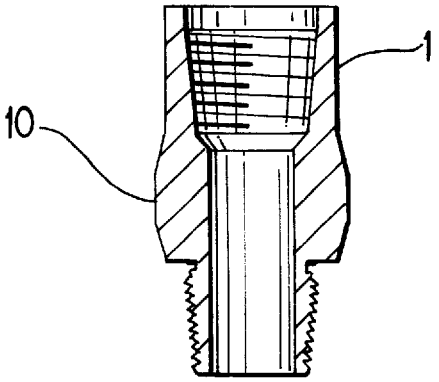
FIG. 2 shows a cross-sectional side view of FIG. 1 in accordance with the present invention.
Figure 3:
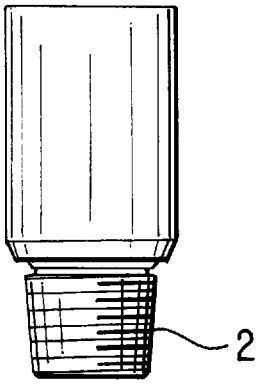
FIG. 3 is a side view of the geotechnical grouting module of the device in accordance with the present invention.
Figure 4:
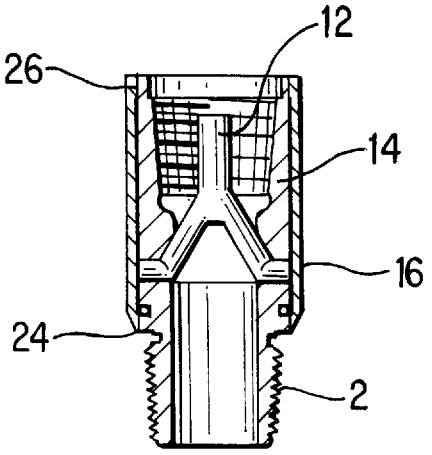
FIG. 4 shows a cross-sectional side view of FIG. 3 in accordance with the present invention.
Figure 5:
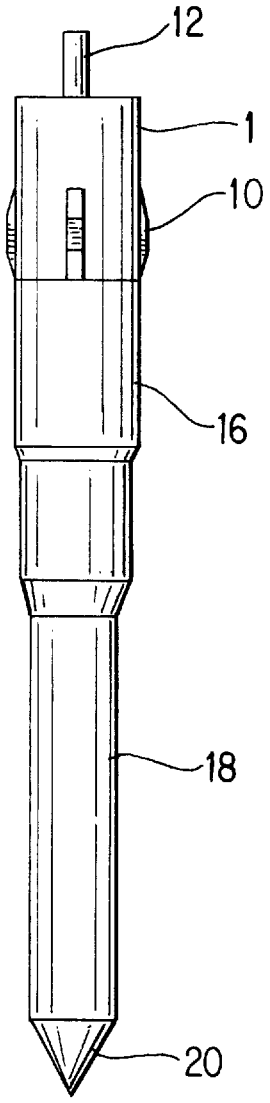
FIG. 5 illustrates a fragmentary side view of the device showing the slidable sleeve covering the grout exit ports during a penetrometer push operation.
Figure 6:
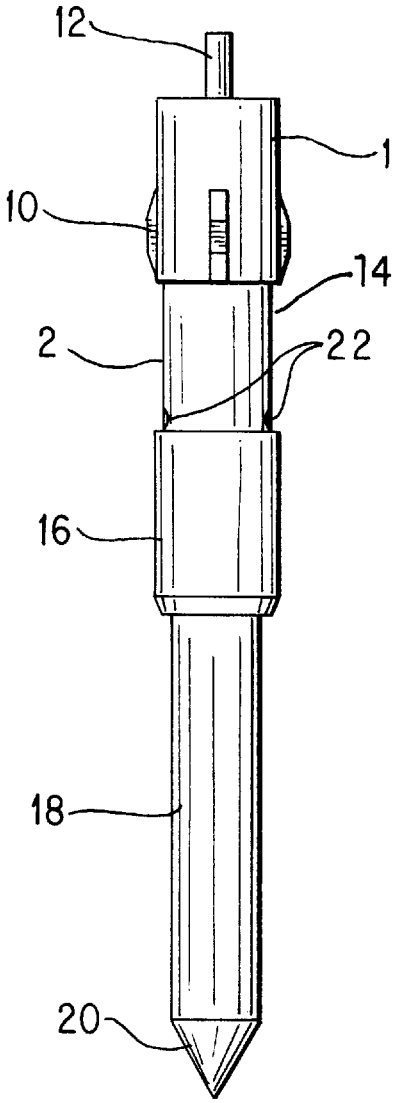
FIG. 6 illustrates a fragmentary side view of the device showing the slidable sleeve retracted for performing grouting of the hole when the penetrometer is retrieved towards the surface.

The invention is a device for use in a cone penetrometer system where a subsurface hole is formed during operational use thereof. More specifically this invention is a grout injection device as shown in FIGS. 5 & 6 that is designed for the injection of a particulate or chemical grout into a hole formed by a cone penetrometer as the penetrometer is withdrawn from down hole to prevent subsurface contamination from spreading along the hole and to other uncontaminated underground strata. The invention includes three major parts: i) a central tubular member 14 that forms part of the grouting module unit that is the same size as a standard cone penetrometer rod 18, ii) a sliding sleeve tubular member 16 that covers the grouting exit ports 22 of a grouting module unit and iii) an adapter unit 1 as shown in FIGS. 1 & 2 that is screwed or attached to the top to the central tubular member 14. The adapter unit 1 functions to limit upward travel of the sliding sleeve member 16 and form channels in the soil side walls formed by the penetrometer by the boss structures 10. The central tubular member 14 feature is hollow so that the central grouting tube 12 as well as other instrument cables, rods or actuating cables can pass through the rod to tools further down the rod. These tools include soil samplers, water samplers, strain gauges, or soil resistivity sensors that are mounted to the penetrometer rod 18 below the grout injection module unit 2. The side walls of the central tubular member 14 are penetrated by grout delivery ports 22 that allow grout to be pumped or otherwise forced out into the soil from a grout delivery tube 12 located inside the module. Pumps and grout metering equipment on the surface force a measured amount of grout down the central grout delivery tube 12 and into tubes connecting to the ports 22 through the side of the central tubular member 14. There can be multiple sidewall exit ports 22 under the sleeve 16 that ensures complete sealing of the hole even when soil obstructs one port during withdrawal of the penetrometer rod. To prevent the grout exit ports 22 from being obstructed by the surrounding soil that squeezes against the walls of the penetrometer rod 18, the sliding sleeve member 16 is positioned in its upward most position. In this position, the upper end of the sleeve member 16 bears against the lower edge of the adapter unit 1 and the sleeve member 16 itself covers the grout exit ports 22. The sleeve member 16 is held in an upper position since movement of the penetrometer rod 18 into the soil forces the sleeve 16 upwards that in turn holds it in contact with the adapter unit 1. A series of raised knobs or bosses 10 are mounted on the adapter unit 1 in such a way so as to displace the soil that surrounds the rod 18. When the penetrometer unit is raised to bring the cone penetrometer string out of the hole and back to the surface, the pressure of the soil around the sleeve member 16 holds it in place, while the central tubular member 14 is moved upward. This movement uncovers the grout exit ports 22 and grout can be pumped down the grout delivery tube 12 and out of the grout exit ports 22. As the rod 18 rises, the flange 26 on the upper end of sliding sleeve member 16 comes into contact with a flange 24 on the lower end of the central tubular member 14. The flange 26 prevents the sliding sleeve member 16 from moving over the flange 24 on the central tubular member 14 and over lower penetrometer sections 18, thus retaining the sleeve member 16 with the grouting module unit 2 as the module and the rods are withdrawn to the surface. Both the adapter unit 1 and grouting injection module unit 2 can be made from either tool steel or stainless steel as needed. The grout tube 12 can be made from any suitable polymeric material such as nylon, PVC or fluorocarbon plastic. These units can be made integral to form a single unit.

While this invention has been described in terms of specific preferred embodiments, it is understood that the invention is capable of further modification and adaptation following in general the principle of the invention and including such departures from the appended claims.

We claim:

1. In grouting devices for grouting a hole formed in the ground by a cone penetrometer system of the type including a means for pumping grout material into the hole, a pipe string formed by a plurality of hollow penetrometer rod sections and a grouting tube internal to the pipe string terminating at a delivery exit port means with at least a single opening, in combination therewith:

a grouting module and an adapter unit comprising:

a beveled sliding sleeve that slidably fits on a central tubular member of the module, the central tubular member is substantially similar in diameter as the penetrometer rod, the grouting module's central region is void and coextensive with the penetrometer rod's central void region with the internal grouting tube communicating with the delivery exit port means, thereby allowing sufficient clearance for ancillary equipment to pass through the grouting module to other equipment attached at lower sections of the penetrometer rod;

the delivery exit port means are disposed on the central tubular member's wall, the opening and closing of the exit port means is controlled by the sliding sleeve; a first flange in an end of the sliding sleeve bears against a mating flange on the central tubular member of the grouting module for preventing the sliding sleeve from sliding down the penetrometer rod during the penetrometer retrieval out of the hole; and the adapter unit is substantially cylindrical, coextensive and attached to the grouting module, the adapter unit is substantially similar in outside diameter as the outside diameter of the sliding sleeve for preventing the sliding sleeve from moving upwards as the penetrometer rod is pushed downward into the hole, the adapter unit's central region is void and coextensive with the penetrometer rod's central void region and has a similar clearance as the grouting module for passage of the grouting tube and ancillary equipment, the adapter unit has multiple raised protuberances mounted external to the adapter unit for displacing soil in the hole's wall surrounding the penetrometer rod thereby forming grooves in the hole walls for even distribution of the grout;

whereby: i) the sliding sleeve moves upward and held in place by the adapter unit to cover the delivery exit port means as the penetrometer rod is inserted into the hole thereby covering the exit port means and preventing soil from plugging the port means; and ii) the sliding sleeve moves downward by friction caused by the hole's soil wall, the sleeve is retained and held in place by the first flange thereby uncovering the grout exit port means and allowing grout to be pumped into surrounding annular space between the grouting module unit and the soil.

2. The grouting device of claim 1 wherein the grouting module and the adapter unit have threaded ends that are compatible with the penetrometer rod.

3. The grouting device of claim 1 wherein the grouting module and the adapter unit are made as an integral unit.

4. A method for sealing ground holes to substantially prevent underground migration of fluid along the hole for a predetermined underground activity during a cone penetrometer system operation, the method comprising:

forming a pipe string of the cone penetrometer system;

pushing the pipe string into the ground, the pipe string including an integral grouting module means for performing a subsurface grout operation during a pipe string withdrawal, said grout module means including a central tubular member fixedly connected to the pipe string at its upper end and having grout exit ports therein and a sliding sleeve movable between a closed position covering the ports and an open position uncovering the ports, the pushing of the cone penetrometer system forms the hole;

performing the predetermined activity prior to withdrawal of the pipe string;

withdrawing the pipe string from the hole thereby moving the sliding sleeve relative to the central tubular member to open said grout exit ports disposed on the grouting module means and delivering liquid grout material into the hole through said grout exit ports.

5. The method of claim 4 wherein the grouting module means is attached to the pipe string at a location above a bottom section of the pipe string thereby enabling attachment of ancillary devices at a tip portion of the pipe string.

6. The method of claim 5 wherein the attached ancillary devices include water samplers, soil samplers, strain gauges, and soil resistivity sensors.

* * * * *